United States Patent [19]

Miyazaki et al.

[11] 4,118,920

[45] Oct. 10, 1978

[54] SYSTEM FOR TRANSPORTING CHEESES PRODUCED BY SPINNING MACHINERY

[75] Inventors: Tsutomu Miyazaki, Kariya; Takashi Kato, Toyota; Yoshihisa Suzuki, Nagoya; Shozo Ueda, Kariya, all of Japan

[73] Assignee: Kabushiki Kaisha Toyoda Jidoshokki Seisakusho, Kariya, Japan

[21] Appl. No.: 778,323

[22] Filed: Mar. 16, 1977

[51] Int. Cl.[2] ..... D01H 9/18

[52] U.S. Cl. ..... 57/34 R; 57/52; 198/461

[58] Field of Search ..... 57/34 R, 52, 54; 242/35.5 A; 198/461

[56] References Cited

U.S. PATENT DOCUMENTS

| | | | |
|---|---|---|---|
| 2,006,870 | 7/1935 | Neuman | 198/461 X |
| 2,570,057 | 10/1951 | Haythornthwaite | 57/52 |
| 3,681,906 | 8/1972 | Burgermeister et al. | 57/52 |
| 3,721,330 | 3/1973 | Crawford et al. | 198/461 |
| 3,906,712 | 9/1975 | Nuyazaki et al. | 57/34 R X |
| 3,942,733 | 3/1976 | Hoffmann | 57/52 X |
| 3,973,906 | 8/1976 | Tooka | 57/34 R X |
| 3,988,880 | 11/1976 | Nizazaki et al. | 57/34 R |

*Primary Examiner*—Charles Gorenstein

*Attorney, Agent, or Firm*—Wenderoth, Lind & Ponack

[57] ABSTRACT

A system for transporting cheeses produced by one spinning machinery into a container located in a predetermined position near the end of the spinning machinery is disclosed. The system comprises a first conveyer extending along the major length of the spinning machinery to receive the doffed cheeses thereon directly from the spinning machinery, and a second conveyor extending between the end of the first conveyer and the container to receive and transport the cheeses from the first conveyer to the container. The second conveyer is driven at a higher speed than the first conveyer to allow the cheeses to be automatically contained in the container which has an inner diameter slightly larger than an outer diameter of the cheese in a manner which allows the bobbins of the cheeses to be stacked in end-to-end relationship.

3 Claims, 3 Drawing Figures

SYSTEM FOR TRANSPORTING CHEESES PRODUCED BY SPINNING MACHINERY

BACKGROUND OF THE INVENTION

This invention relates to spinning machinery, such as a spinning frame, a false twisting machine, a double twister or a winder, and more particularly to a system for transporting cheeses, which were produced by one spinning machinery, to one end of the spinning machinery therealong.

In an open end spinning frame, for example, a series of spinning units are arranged between head stocks wherein drive motors, gear boxes and control mechanisms are located. A sliver from each can is spun by a spinning device of the spinning unit into a yarn which is, in turn, taken up by a spun yarn take-up roller and wound through a grooved winding roller on a bobbin to be formed into a yarn package or cheese. Each cheese is doffed and typically placed onto a conveyer provided along the spinning frame. Then, the conveyer is driven to transport the cheeses to the end of the spinning frame where they are transferred into a suitable container, which is in turn transported to a separate apparatus to permit the cheeses to be subject to the next processing step of the spinning.

Such a cheese transporting system, however, involves certain disadvantages. For example, in the case of the conveyer being driven at a normal low speed suitable to transport the cheeses, postures of the cheeses when leaving the conveyer may change from cheese to cheese due to the low speed of the conveyer. This requires the container to be of a large diameter so as not to permit the cheese to contact against the upper peripheral edge of the container when they are transferred into the container. Therefore, the cheeses in the container are irregular in position, with the resultant disadvantages that the adjacent cheeses rub each other, thus producing yarns of poor quality, and that additional time and labor are required at the next processing step of the spinning.

To avoid these disadvantages, it is known to utilize, instead of the container described above, a can having a diameter slightly larger than that of the cheese. The cheeses transferred through the end of the spinning frame are canistered into the can in a manner allowing bobbins of the cheeses to be stacked in an end-to-end relationship. Such a cheese transporting system is disclosed in U.S. Pat. No. 3,973,906—T. Tooka, assigned to the same assignee as the present invention. However, in this case, the conveyer has to be driven at an excessively high speed so that the cheeses may be automatically stacked in the end-to-end relationship. This speed is excessively high as compared with the previously mentioned speed necessary for merely transporting the cheeses, and it is a waste of electric power to drive the conveyer at such a speed. In addition, if the conveyer transports the cheeses with one mounting another for any reason, it is difficult to carry on the transferring of the cheeses into the can unerringly.

SUMMARY OF THE INVENTION

It is, accordingly, an object of the invention to provide a system for transporting cheeses produced by spinning machinery to the end thereof while eliminating all the above disadvantages.

With this object in view, the invention resides in a system for transporting cheeses produced by one spinning machinery into a container located at a predetermined position adjacent the end of the spinning machinery therealong, the system comprising a first conveyer extending along the major length of the spinning machinery for a purpose of transporting the cheeses along the spinning machinery, and a second conveyer receiving the cheeses from the first conveyer and extending along the remaining length of the spinning machinery for a purpose of smoothly accommodating the cheeses into the container, the second conveyer being driven at a greater speed than the first conveyer.

BRIEF DESCRIPTION OF THE DRAWING

The invention will become more readily apparent from the following detailed description taken in conjunction with the accompanying drawing in which.

DESCRIPTION OF THE EMBODIMENT

Figure 3:
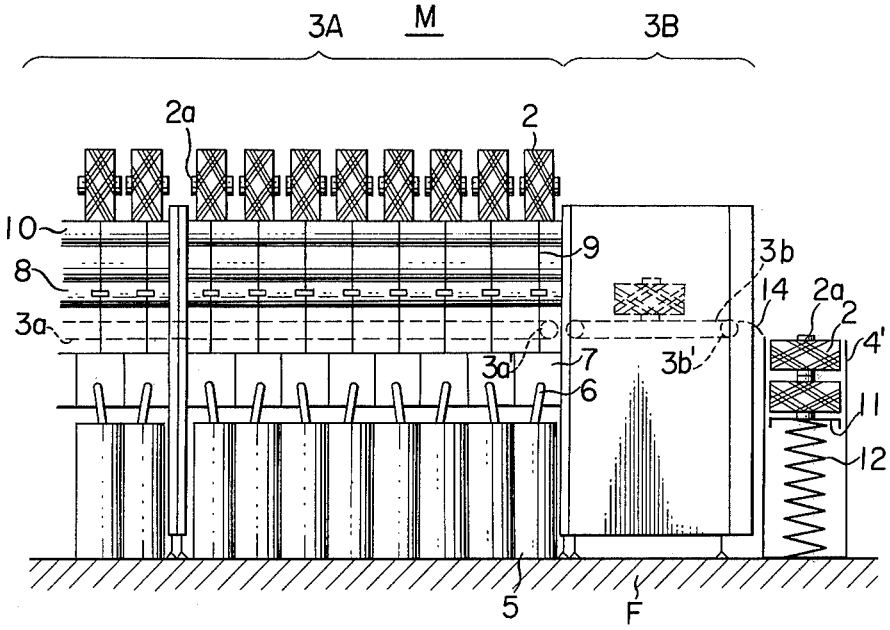
FIG. 3 is a fragmental elevational view of an open end spinning frame employing a cheese transporting system according to the invention.

Referring now to FIG. 3, there is shown on a floor F an open end spinning frame M embodying the teachings of the invention. Although the following description is made with respect to a particular spinning machine that is an open end spinning frame, the invention is of course not limited thereto. In FIG. 3, a plurality of yarn or sliver processing devices, that is, spinning devices 7 are arranged in side-by-side relationship in two longitudinal, generally parallel rows (not shown) and between head stocks 1 (for convenience, only one is shown), in which not shown drive motors, gear boxes and a control mechanism are located. A sliver 6 from each can 5 is spun by the associated spinning device 7 into a yarn 9 which is then taken up by a spun yarn take-up roller 8 and wound through a grooved winding roller 10 on a bobbin 2*a*, thus being formed into a cheese or yarn package 2. The bobbins 2*a* are held for rotation by respective bobbin holders (not shown). The formed cheeses 2 are doffed from the associated holders to enable them to be subjected to their next treatment.

Figure 1:
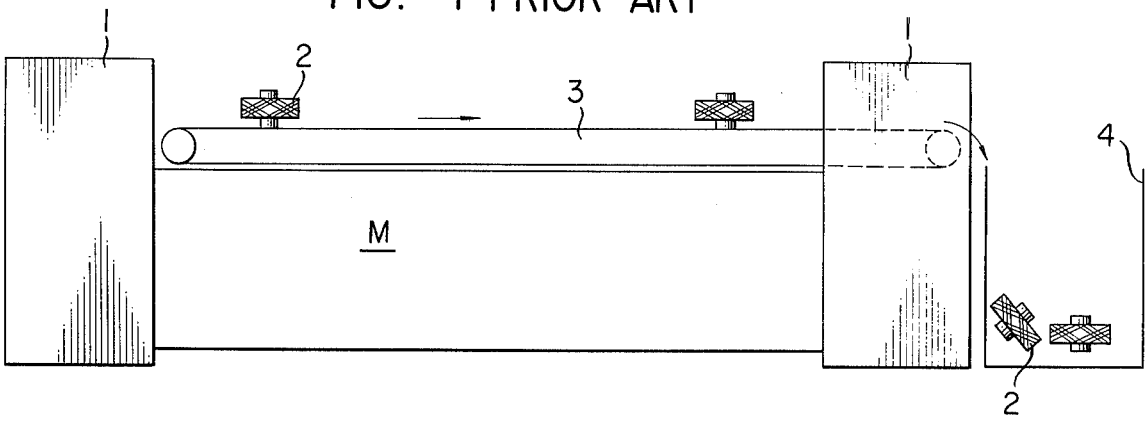
FIG. 1 PRIOR ART
FIGS. 1 and 2 are diagrammatic views of open end spinning frames employing conventional systems for transporting cheeses, respectively.

In FIG. 1, an open end spinning frame M having the arrangement previously described is provided with a conventional cheese transporting system comprising a single conveyer 3 extending from a point near a boundary between one head stock 1 (in this Figure, the left head stock) and the endmost spinning device and along the spinning frame M to the outer end of the other head stock 1. Upon driving of the conveyer 3, the cheese 2 is transferred thereby into a generally cylindrical container 4 located in a predetermined position adjacent the head stock 1. Since the conveyer 3 is generally driven at a relatively low speed, the cheese 3 may leave the conveyer 3 in different postures as described before. It is therefore understood that the container 4 has to be of a larger diameter than that of the cheese so as to receive the cheeses therein smoothly. This causes the cheeses 2 to be positioned at random in the container, with the disadvantageous results that not only can the container 4 can not contain the maximum possible number of cheeses, but additional time and labor are required at the further processing station. In addition, the adjacent cheeses in the container 4 may rub with each other, thus producing spun yarn of poor quality.

Figure 2:
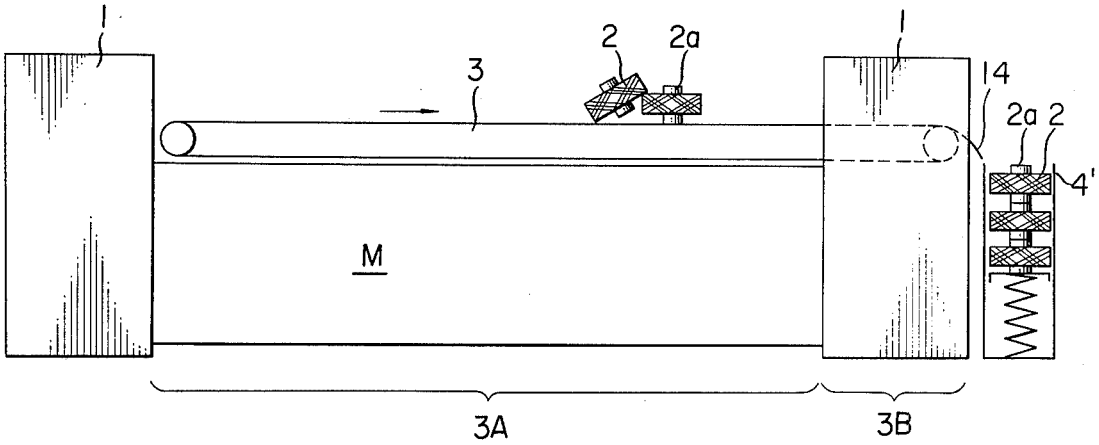
FIG. 2 PRIOR ART

Shown in FIG. 2 is a spinning frame employing a cheese transporting system, in which the cheeses are moved over a guide plate 14 and received into a container 4' of a diameter slightly larger than that of the cheese in a manner allowing the bobbins 2*a* of the cheeses to be stacked an end-to-end relationship. Although this system can eliminate the disadvantages described with reference to FIG. 1, experiments have shown that in this system the conveyer 3 is required to run at a relatively high speed to give the cheeses a relatively high initial velocity when they leave the conveyer in order to ensure that the cheeses 2 are automatically stacked in the above manner. This is because the diameter of the container 4' is only slightly larger than that of the cheeses. According to experiments, the necessary speed of the conveyer 3 was about 40 meters per minute in order to accommodate a cheese, for example, having a diameter of 280 mm, a width of 90 mm and a weight of 1.9 Kg, into the container 4' of FIG. 2 smoothly and unerringly. This speed of the conveyer 3 is much higher than the at which the cheeses are normally transported in the spinning frame of FIG. 1.

Thus, it is understood that the system illustrated in FIG. 2 requires the whole, relatively long conveyer to be driven at the relatively high speed, so that electric power consumption of the conveyer 3 increases and the system becomes expensive. In addition, when the cheeses 2 reach the end of the conveyer 3 under superimposed or overlapped condition as shown in FIG. 2, it is not possible to transfer these cheese into the container 4' smoothly.

The present invention can eliminate the disadvantages of the system illustrated in FIG. 2 by transporting the cheeses 2 at a lower speed when present in a region 3A and then at a higher speed in a region 3B. The region 3A generally extends throughout the body of the spinning frame M and the region 3B generally extends throughout the head stock 1 of the spinning frame M.

Referring back to FIG. 3, there is shown a system for transporting cheeses 2 according to the present invention. In this system, the cheese container 4' is formed in a cylindrical shape similar to the can 5 with an inner diameter slightly larger than the outer diameter of the cheese 2. Within the container 4', a cheese receiving plate 11 is carried for upward and downward movement by a resilient means consisting of a coil spring 12, which is disposed between the plate 11 and the bottom of the container 4' to normally urge the cheese receiving plate 11 upwardly. It is preferable that the coil spring 12 have a suitable spring constant which allows the height of the coil spring to just change by an amount corresponding to the length of the bobbin every time one cheese is taken out of or placed in the container 4', since this facilities the putting in and taking out of the cheeses. As stated previously, the cheeses 2 are canistered in the container 4' with their bobbins 2*a* being arranged in end-to-end relationship.

In order to allow the cheeses 2 to be stacked in the aforementioned manner, the system according to the invention comprises a first conveyer 3*a* extending along the region 3A and beside all the spinning units 7 for the purpose of transporting the doffed cheeses 2 along the spinning frame, and a second conveyer 3*b* extending along the region 3B. One end of the second conveyer 3*b* is arranged near the end of the first conveyer 3*a* to unerringly receive the cheeses 2 thereon and the other end of the second conveyer 3*b* is located near the container 4'. Between the other end of the second conveyor 3*b* and the container 4', there is a guide plate 14 to guide the cheese 2 into the container 4'. Therefore, it is understood that the second conveyer 3*b* acts rather to put the cheeses 2 into the container 4' in the above manner than to transport along the spinning frame M. It is also understood that the second conveyer 3*b* may be of a shorter length than that shown in FIG. 2, sence the conveyer 3*b* corresponds to length to the region 3B or the head stock 1.

The first and second conveyers 3*a* and 3*b* each having conveyer belts are driven at different speeds. According to experiments, for example, in the case of a cheese 2 having an outer diameter of 280 mm, a width of 90 mm, and a weight of 1.9 Kg, it was necessary to drive the second conveyer 3*b* at about 40 meters per minute to unerringly put the cheeses 2 into the container 4' in the intended posture shown in FIG. 3. The speed of the first conveyer 3*a* may be selected regardless of the second conveyer 3*b* and is normally on the order of about 10 meters per minute. It is desireable that the speed of the second conveyer 3*b* can be adjusted in response to changes in dimensions and weight of the cheeses so as to always carry out the secure placement of the cheeses 2.

In FIG. 3, the system is desireably divided into the first and second conveyers 3*a* and 3*b* at between the head stock 1 and the endmost spinning device 7 of the spinning frame in terms of assembling and installation of the spinning frame at a mill, although the invention is not limited thereto.

In operation, the doffed cheeses 2 are placed from the not shown respective bobbin holders on the first conveyer 3*a* and transported thereby along the spinning frame M at the lower speed of about 10 m/min. Then, the cheeses are transferred from the first conveyer 3*a* to the second conveyer 3*b*, which moves the cheeses toward the container 4' at the higher speed of about 40 m/min, which allows the cheeses to leave the end of the second conveyer 3*b* at the suitable initial velocity to be accomodated in the container 4' in end-to-end relationship. The guide plate 14 guides the putting of the cheeses from the end of the second conveyer 3*b* into the container 4'.

Each of the first and second conveyers 3*a* and 3*b* may comprise an endless belt driven by a driving roller 3*a*' or 3*b*' which is, in turn, driven by suitable driving means (not shown).

It is appreciated from the above description that the system according to the invention can greatly reduce electric power consumption in comparison with the prior system shown in FIG. 2, since there is no need for driving the whole system at the high speed as a whole, and that even if the cheeses 2 on the first conveyer 3*a* are conveyed toward the second conveyer 3*b* with one mounting another as shown in FIG. 2, they can be separated from each other with ease when they are received onto the second conveyer 3*b*, since the second conveyer 3*b* is driven at the higher speed than the first conveyer 3*a*. This results in the reliable accommodation of the cheeses into the container 4'. Furthermore, since the first conveyer 3*a* driven at the lower speed gets a major share of the length of the transporting system, effective lives of mechanical parts, such as conveyer bearings and endless belts can be prolonged.

Although the invention has been described and illustrated with reference to a single embodiment thereof, it is to be understood that various changes may be made without departing from the spirit and scope of the invention.

What we claim is:

1. In a spinning machinery which has:

a plurality of longitudinally aligned spinning unit means for producing yarn to be wound on a take-up bobbin to produce a cylindrical yarn cheese;

head stocks at each end of said longitudinally aligned spinning unit means, a first head stock at one end and a second head stock at the other end;

open ended container means with an inside diameter slightly larger than said yarn cheese located adjacent said second head stock for containing said yarn cheeses; and a single, horizontal conveyor means running horizontally between said head stocks above said spinning unit means for transporting said yarn cheeses at a uniform speed from said spinning unit means to said container means;

an improvement comprising:

two horizontal conveyor means above said spinning unit means for transporting said yarn cheeses from said spinning unit means to said container means at varying speeds, said two horizontal conveyor unit means being comprised of:

a first horizontal conveyor means positioned above said spinning unit means between said first and second head stocks for transporting said yarn cheeses from said spinning unit means to said second head stock at a uniform speed, and a second horizontal conveyor means horizontally aligned with said first horizontal conveyor means and operating at a uniform speed higher than that of said first conveyor means, said second conveyor means being mounted on said second head stock between said first conveyor means and said container means for receiving said yarn cheeses from said first conveyor means and carrying said yarn cheeses to said container means at a speed faster than said first conveyor means.

2. An improvement as claimed in claim 1, wherein said first and second conveyer means are each comprised of a pair of spaced drive rolls and an endless belt surrounding each pair of drive rolls.

3. An improvement as claimed in claim 1, wherein said first conveyer means is driven at a speed of less than 40m/min.

* * * * *